US009277795B2

(12) United States Patent
An

(10) Patent No.: US 9,277,795 B2
(45) Date of Patent: Mar. 8, 2016

(54) BOX FOR PACKING

(71) Applicant: Samsung Electronics Co., Ltd., Gyeonggi-do (KR)

(72) Inventor: Dae-Geun An, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/292,529

(22) Filed: May 30, 2014

(65) Prior Publication Data

US 2014/0353313 A1 Dec. 4, 2014

(30) Foreign Application Priority Data

May 30, 2013 (KR) ..... 10-2013-0061890

(51) Int. Cl.

| | |
|---|---|
| ***B65D 43/22*** | (2006.01) |
| ***A45C 5/02*** | (2006.01) |
| ***A45C 11/24*** | (2006.01) |
| ***A45C 13/10*** | (2006.01) |
| *B65D 43/16* | (2006.01) |

(52) U.S. Cl.

CPC . *A45C 5/02* (2013.01); *A45C 11/24* (2013.01); *A45C 13/10* (2013.01); *B65D 43/162* (2013.01)

(58) Field of Classification Search

USPC ..... 220/230, 822, 826, 259.2, 326, 254.3, 220/254.4, 254.5, 254.6, 254.7, 259.1, 220/254.1, 260; 24/303, 666, 589.1, 590.1, 24/593.1, 595.1, 596.1; 292/251.5; 229/125.39, 125.41; 206/1.5, 320; 403/353

See application file for complete search history.

(56) References Cited

U.S. PATENT DOCUMENTS

| | | | | |
|---|---|---|---|---|
| 1,479,328 | A * | 1/1924 | Sinel | 229/103.2 |
| 2007/0138806 | A1* | 6/2007 | Ligtenberg et al. | 292/251.5 |
| 2011/0031766 | A1 | 2/2011 | Huang et al. | |
| 2014/0034080 | A1* | 2/2014 | Paquet et al. | 132/286 |

FOREIGN PATENT DOCUMENTS

| | | |
|---|---|---|
| KR | 10-2008-0024628 | 3/2008 |
| KR | 10-2012-0075738 | 7/2012 |
| KR | 10-2012-0094760 | 8/2012 |

* cited by examiner

*Primary Examiner* — Mickey Yu
*Assistant Examiner* — Allan Stevens

(57) ABSTRACT

Provided is a box includes a box body having an opened upper portion; a first cover openably disposed to seal the opened portion of the box body; a second cover openably disposed to overlap on at least partially; and a slide button operably disposed on the second cover to fix the second cover to the first cover.

17 Claims, 15 Drawing Sheets

BOX FOR PACKING

PRIORITY

The present application is related to and claims priority under 35 U.S.C. §119 to an application filed in the Korean Intellectual Property Office on May 30, 2013 and assigned Serial No. 10-2013-0061890, the contents of which are incorporated herein by reference.

TECHNICAL FIELD

The present disclosure relates generally to a box for storing a product.

BACKGROUND

In recent years, developed packing boxes are applied to various fields that are closely related to our everyday lives. Particularly, such a packing box is not only used for simply packing products, but also used as a container for storing living goods such as accessories.

Since such a livingware is small and slim and easily lost and broken, it requires careful attention with respect to storage. Thus, the packing box has an enclosure shape with an opened upper portion and is covered with a separate cover.

Since the above-described packing box is partially sealed to effectively protect products when the products are packaged and transported, a portion of the packing box has to be damaged so as to take the products out of the packing box. As a result, the damaged box is recognized as a disposable product because it does not function as a box any longer. Thus, it is necessary to recycle the packing box and effectively store products.

SUMMARY

To address the above-discussed deficiencies, it is a primary object to provide a packing box that is capable of easily storing products.

The present disclosure provides a packing box that is recyclable.

Embodiments of the present disclosure provide a packing box that operates intuitively.

According to embodiments of the present disclosure, a box includes a box body having an opened upper portion; a first cover openably disposed to seal the opened portion of the box body; a second cover openably disposed to overlap on the closed first cover at least partially; and a slide button operably disposed on the second cover to fix the second cover to the first cover.

The box may further include a connection part connecting the first cover to the second cover.

The first cover, the second cover, and the connection part can be integrally formed with each other.

The box body can be disposed on a top surface of the connection part, and the connection part is disposed to surround the box body.

The second cover can include a long hole having a predetermined length.

The slide button operates in the long hole.

The first cover includes an accommodation part in which the slide button is received.

The accommodation part includes: an introduction part in which the slide button is first received; a guide part extending from the introduction part to guide the slide button; and a hook groove in which the slide button is fitted.

The accommodation part can further include a hook unit preventing the slide button from unintentionally moving in a locked or unlocked direction.

The hook unit includes at least one of an elastic member, a cam, and a ball plunger.

The first cover includes a hook protruding toward the accommodation part to prevent the slide button from moving in a locked or unlocked direction.

The box can be formed of at least one of wood, a synthetic resin, and a metal.

The slide button can include a first magnet body having one polarity.

The first cover includes a second magnet body disposed so that different polarities of the first and second magnet bodies face each other, thereby fixing second cover by using attractive force.

The first cover can include a third magnet body disposed so that the same polarity of the first and second magnet bodies faces each other, thereby opening the second cover by using repulsive force.

The second and third magnet bodies can have the same operational distance as the slide button.

According to embodiments of the present disclosure, a box includes: a box body having an opened upper portion, the box body having side surfaces sealed by sidewalls; a first cover rotatably fixed to one side of the box body to at least partially close the opened portion of the box body; a second cover rotatably fixed to the other side of the first cover, the second cover being disposed to allow at least one portion of the second cover to partially overlap the closed first cover. The box includes a slide button disposed with an operational distance corresponding to a predetermined length; a first magnet body disposed on a portion of the slide button at which the first magnet body faces the first cover; an accommodation part having a length corresponding to the operational distance of at least the slide button in the portion at which the first cover overlaps the second cover, the accommodation part having a hook groove selectively hooking the slide button; a second magnet body disposed so that the same polarity of the first and second magnet bodies faces each other to generate a repulsive force at a position at which the slide button is unlocked; and a third magnet body disposed so that different polarities of the first and third magnet bodies face each other to generate an attractive force at a position at which the slide button is locked.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. Embodiments of the present disclosure will be described herein below with reference to the accompanying drawings. Hereinafter, various embodiments of the present disclosure will be described in detail with reference to the accompanying drawings. Moreover, detailed descriptions related to well-known functions or configurations may be ruled out in order not to unnecessarily obscure subject matters of the present disclosure. Also, the terms used herein are defined according to the functions of the present disclosure. Thus, the terms may vary depending on user's or operator's intentions or practices. Thus, the definitions should be determined based on the overall content of the various embodiments of the present disclosure.

Figure 1:
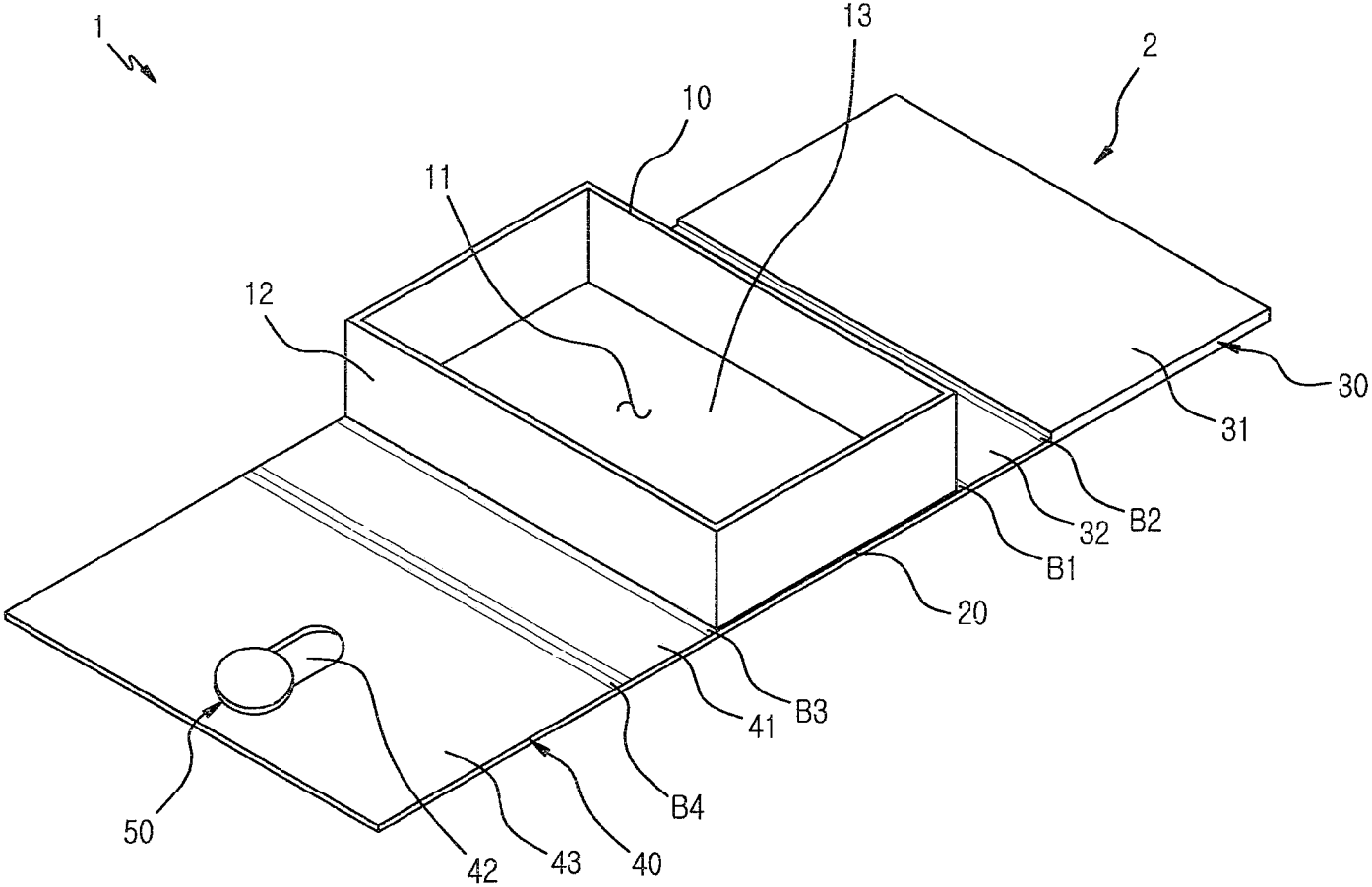
FIG. 1 illustrates a perspective view of a configuration of a packing box according to various embodiments the present disclosure.

FIG. 1 is a perspective view illustrating a configuration of a packing box according to various embodiments the present disclosure.

Referring to FIG. 1, a packing box 1 includes an accommodation space 11 and includes a box body 10 with an opened upper portion and a cover body 2 covering the box body 10.

The box body 10 includes a plate 13 having a predetermined area and a plurality of sidewalls 12 each extending by a predetermined height from the plate 13. The sidewalls 12 can be installed or formed to surround edges (borders) of the plate 13. The sidewalls 12 have closed side surfaces except for the accommodation space 11 with the opened upper portion. When the cover body 2 covers the box body 10, the sidewalls 12 are closely attached to adhesion parts 32 and 41 of the cover body 2, respectively. The sidewalls 12 disposed on the edges of the plate 13 have the same height to seal the accommodation space 11 by a first cover 30 when the cover body 2 covers an upper portion of the box body 10. The box body 10 is fixed to a portion of the cover body 2.

The cover body 2 includes a connection part 20 supporting the box body 10 and connecting the first cover 30 to a second cover 40, the first cover 30 openably disposed to seal the opened portion of the box body 10, and the second cover 40 openably disposed to at least partially overlap on the first cover 30.

The connection part 20 has a plate shape and is disposed on a lower portion of the box body 10 to support the box body 10. The connection part 20 may have a top surface closely fixed to a bottom surface of the box body 10.

The first cover 30 may include a first adhesion part 32 extending toward a side from the connection part 20 and a first cover part 31 extending from the first adhesion part 32 and having a thickness greater than that of the first adhesion part 32. According to the various embodiments of the present disclosure, when the cover body 2 covers the box body 10, the first adhesion part 32 is closely fixed to one sidewall 12 of the box body 10 by a first foldable part B1.

When the cover body 2 covers the box body 10, the first cover part 31 is openably disposed to seal the opened portion of the box body 10 by a second foldable part B2. Here, the first cover part 31 is disposed on an upper portion of the sidewall 12 and be supported by the sidewall 12.

More particularly described below is an accommodation part (see reference numeral 33 of FIG. 2) having a key shape defined in a bottom surface 34 of the first cover part 31. The accommodation part 33 accommodates a slide button 50.

The second cover 40 includes a second adhesion part 41 extending toward the other side from the connection part 20 and a second cover part 43 extending from the second adhesion part 41. According to the various embodiments of the present disclosure, when the cover body 2 covers the box body 10, the second adhesion part 41 can be closely fixed to the other sidewall 12 of the box body 10 by a third foldable part B3.

When the cover body 2 covers the box body 10, the second cover part 43 can secondly cover the opened portion of the box body 10 by folding at a fourth foldable part B4. According to embodiments of the present disclosure, when the first cover part 31 seals the opened portion of the box body 10, the second cover part 43 can be openably disposed to at least partially overlap on the first cover part 31.

The second cover 40 includes a hole 42 defined by a predetermined length in a top surface of the second cover 40. The hole 42 accommodates the slide button 50 to allow the slide button 50 to move in a longitudinal direction. The hole 42 may be changed in size or position according to a shape of the slide button 50. Also, the hole 42 can be defined to correspond to an accommodation part (see reference numeral 33 of FIG. 2) that will be described below.

According to various embodiments of the present disclosure, the first cover 30, the second cover 40, and the connection part 20 can be integrally formed with each other. Also, the cover body 2 can be disposed to surround the box body 10. The box body 10 and the cover body 2 can be formed of at least one material of wood, a synthetic resin, and a metal.

More particularly described below is that the slide button 50 operates in a state where the slide button 50 is inserted into the hole 42 that is defined in the second cover part 43. The slide button 50 includes a button part (see reference numeral 53 of FIG. 5) protruding to the outside, an attachment part (see reference numeral 51 of FIG. 5) including a magnet body, and a support part 52 connecting the button part 53 to the attachment part 51. The slide button 50 can be received in the accommodation part (see reference numeral 33 of FIG. 2) that is defined in bottom surface 34 of the first cover part 31.

Figure 2:
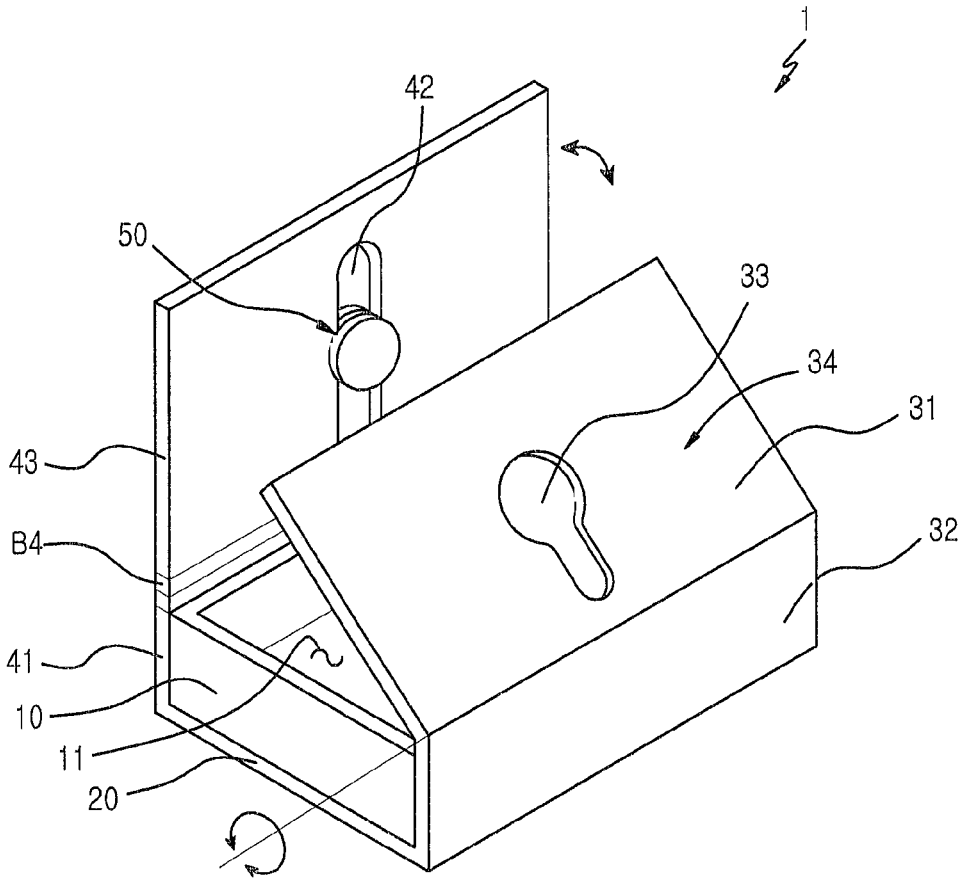
FIG. 2 illustrates a perspective view of a state in which a cover body is applied to a box body of a packing box according to embodiments of the present disclosure.

FIG. 2 is a perspective view of a state in which a cover body is applied to a box body of a packing box according to embodiments of the present disclosure.

Referring to FIG. 2, a cover body 2 of a packing box 1 can be disposed to surround a box body 10. According to the various embodiments, the box body 10 has a bottom surface and one side surface, which are fixed to the cover body 2.

As described in reference to FIG. 1, the box body 10 includes the plate 13 having the predetermined area and the plurality of sidewalls 12 each extending by the predetermined height from the plate 13. The sidewalls 12 are installed or formed to surround edges of the plate 13. The sidewalls 12 have closed side surfaces except for an accommodation space 11 with an opened upper portion. The sidewalls 12 can be fixed to adhesion parts 32 and 41 of the cover body 2, respectively. Since the sidewalls 12 disposed on the edges of the plate 13 have the same height as each other, the accommodation space 11 can be sealed by a first cover 30 when the cover body 2 covers the opened portion of the box body 10.

The cover body 2 includes a connection part 20 supporting the box body 10 and connecting the first cover 30 to the second cover 40, the first cover 30 openably disposed to seal the opened portion of the box body 10, and the second cover 40 openably disposed to at least partially overlap on the first cover 30.

The connection part 20 has a plate shape and is disposed on a lower portion of the box body 10 to support the box body 10. The connection part 20 connects the first cover 30 to the second cover 40. Also, the connection part 20 includes a top surface closely fixed to the bottom surface of the box body 10.

The first cover 30 includes a first adhesion part 32 closely attached to one sidewall 12 of the box body 10 and a first cover part 31 rotatably extending from the first adhesion part 32.

The first cover part 31 can rotate at a predetermined angle. The first cover part 31 can be disposed on an upper portion of each of the sidewalls 12 of the box body 10. That is, the first cover 30 seals the opened portion of the box body 10. Here, the first cover part 31 includes one end that is in contact with a portion of the second cover 40.

According to the various embodiments of the present disclosure, an accommodation part 33 having a key shape is defined in a bottom surface 34 of the first cover part 31. The accommodation part 33 accommodates a slide button 50. Also, a magnet body for magnetically fixing the slide button 50 is disposed on a lower portion of the accommodation part 33.

The second cover 40 includes the second adhesion part 41 closely attached to the other sidewall 12 of the box body 10 and a second cover part 43 rotatably extending from the second adhesion part 41.

The second cover part 43 can rotate at a predetermined angle. When the first cover part 31 seals the opened portion of the box body 10, the second cover part 43 can be openably disposed to at least partially overlap on the first cover part 31.

According to the various embodiments of the present disclosure, a hole 42 having a predetermined distance is defined in the top surface of the second cover 40. The slide button 50 can move in a longitudinal direction of the hole 42. The hole 42 size or position is according to a shape of the slide button 50. The hole 42 is defined to correspond to the accommodation part 33.

The slide button 50 operates in a state where the slide button 50 is inserted in the hole 42 defined in the second cover part 43. The slide button 50 includes a button part 53 protruding to the outside, an attachment part 51 including a magnet body, and a support part 52 connecting the button part 53 to the attachment part 51. The slide button 50 is accommodated in the accommodation part 33 defined in the bottom surface 34 of the first cover part 31. According to the various embodiments of the present disclosure, the attachment part 51 including the magnet body can pull the magnet body of the first cover part 31 due to attraction force or can push the magnet body of the first cover part 31 due to repulsion force.

Figure 3:
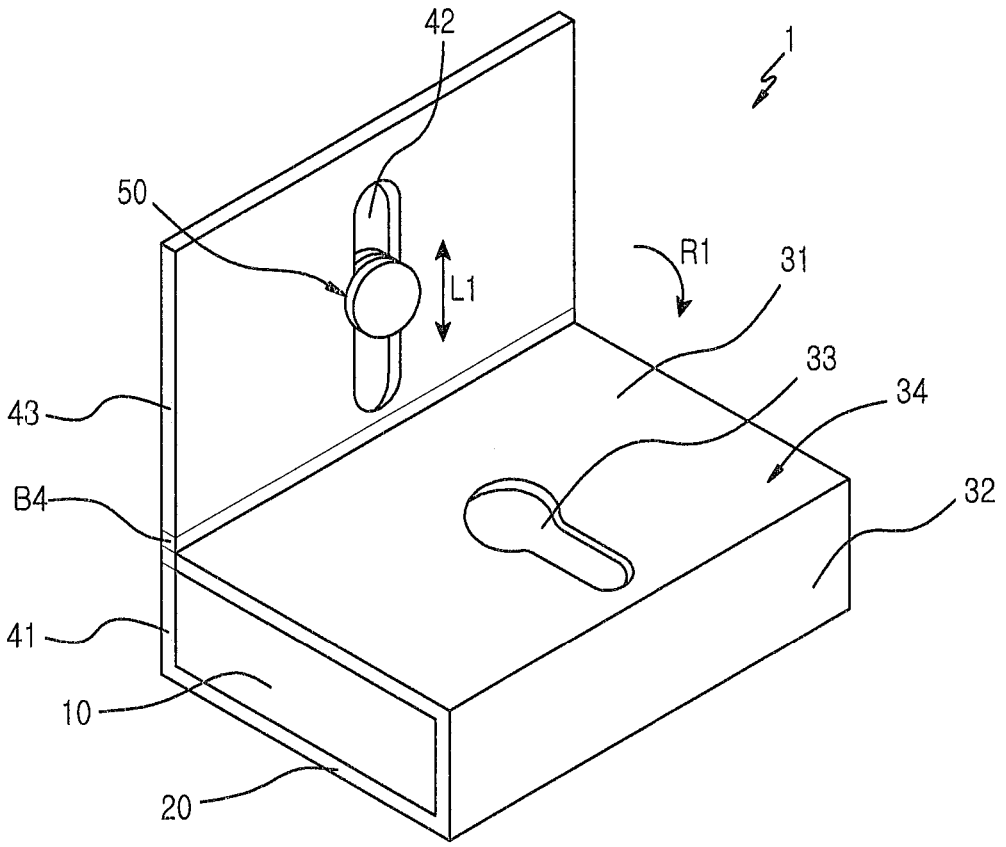
FIG. 3 illustrates a perspective view of a state in which a cover body is applied to a box body of a packing box according to embodiments of the present disclosure.

FIG. 3 is a perspective view of a state in which a cover body is applied to a box body of a packing box according to embodiments of the present disclosure.

Referring to FIG. 3, an opened portion of a box body 10 is sealed by a first cover part 31. According to an embodiment, the first cover part 31 is disposed on upper portions of sidewalls 12 of the box body 10. The first cover part 31 includes an end closely attached to a portion of the second cover 40. Also, as indicated by the arrow R1 in FIG. 3, a second cover part 43 can rotate at a predetermined angle. The second cover part 43 can be disposed to at least partially overlap on the first cover part 31.

A hole 42 having a predetermined length is defined in a top surface of the second cover 40. A slide button 50 operates in a longitudinal direction L1 of the hole 42. The hole 42 can be changed in size or position according to a shape of the slide button 50. The hole 42 is defined to correspond to the accommodation part 33.

An accommodation part 33 having a key shape is defined on the bottom surface 34 of the first cover part 31. The accommodation part 33 accommodates the slide button 50. Also, a magnet body for magnetically fixing the slide button 50 is disposed on a lower portion of the accommodation part 33.

The slide button 50 operates in a state where the slide button 50 is inserted in the hole 42 defined in the second cover part 43. The slide button 50 includes a button part 53 protruding to the outside, an attachment part 51 including a magnet body, and a support part 52 connecting the button part 53 to the attachment part 51. The slide button 50 can be lodged in the accommodation part 33 defined in the bottom surface 34 of the first cover part 31. According to the various embodiments of the present disclosure, the attachment part 51 including the magnet body pulls the magnet body of the first cover part 31 due to attraction force or pushes the magnet body of the first cover part 31 due to repulsion force.

Figure 4:
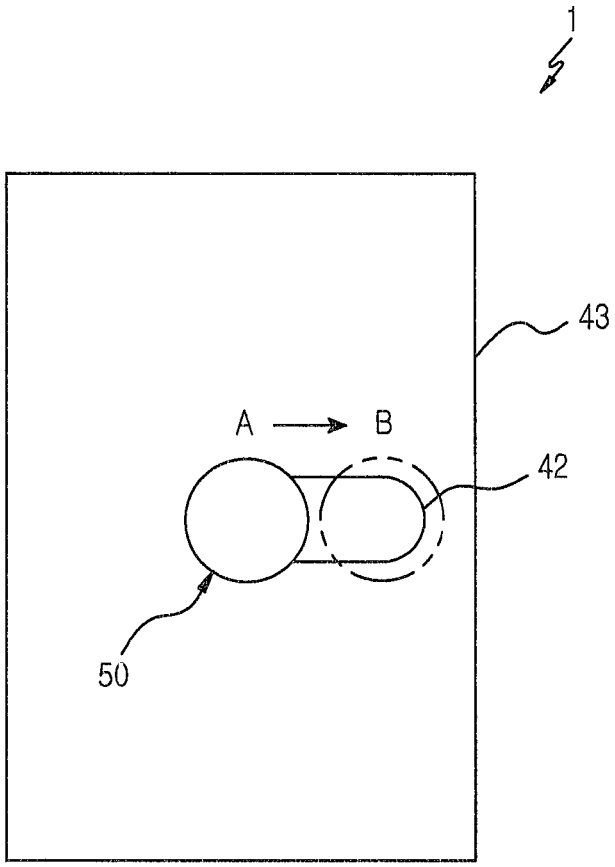
FIG. 4 illustrates an operation of a slide button of the packing box according to the various embodiments of the present disclosure.

FIG. 4 illustrates an operation of a slide button of the packing box according to the embodiment of the present disclosure.

FIG. 4 illustrates a state in which the second cover part 43 at least partially overlaps on the first cover part 31 in the state of FIG. 3. As described above, the slide button 50 can be accumulated in the accommodation part 33 to move to a right side.

According to embodiments of the present disclosure, when the slide button 50 is located at an unlocked position A, the first cover 30 can be moved by external force. When the slide button 50 is located at a locked position B, the second cover 40 is fixed to the first cover 30.

According to the various embodiments of the present disclosure, the slide button 50 includes a first magnet body (see reference symbol M1 of FIG. 6B) having one polarity, and the first cover 30 includes a second magnet body (see reference symbol M2 of FIG. 6B) having repulsive force against the first magnet body M1. The second magnet body M2 can be located at the unlocked position A. In certain embodiments, the first and second magnet bodies M1 and M2 have polarities different from each other (for example, a N pole and a S pole), respectively. In this case, the first and second magnet bodies M1 and M2 can be disposed so that the same polarity thereof faces each other to generate the repulsive force against each other. According to the various embodiments of the present disclosure, the first cover 30 can further include a third magnet body (see reference symbol M3 of FIG. 6B) having attractive force with respect to the first magnet body M1. The third magnet body M3 is located at the locked position B. That is, the first and second covers 30 and 40 can be fixed according to the position of the slide button 50. According to embodiments of the present disclosure, the first and third magnet bodies M1 and M3 have polarities different from each other (for example, a N pole and a S pole), respectively. In this case, the first and third magnet bodies M1 and M3 are disposed so that the different polarity thereof faces each other to generate the attractive force against each other.

Figure 5:
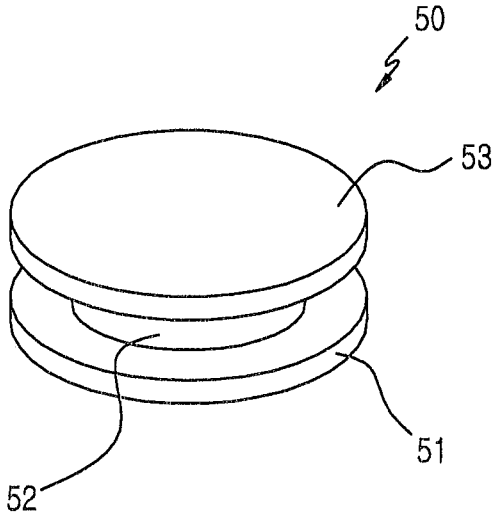
FIG. 5 illustrates a configuration of the slide button of the packing box according to the various embodiments of the present disclosure.

FIG. 5 illustrates a configuration of the slide button of the packing box according to the various embodiments of the present disclosure.

Referring to FIG. 5, the slide button 50 includes the button part 53 protruding to the outside so as to be operated by a user, the attachment part 51 including the magnet body having one polarity, and the support part 52 connecting the button part 53 to the attachment part 51.

The button part 53 has a predetermined thickness so that the user can easily operate the slide button 50. The support part 52 has a predetermined thickness so that the support part 52 operates in a state where the support part 53 is inserted in the long 42 of the second cover part 43. Also, the support part 52 has a predetermined thickness to correspond to that of the accommodation part 33 of the first cover part 31.

The attachment part 51 includes a magnet body having a N pole or a S pole, and the magnet body is fixed within the attachment part 51. As shown in FIG. 4, when the slide button 50 is located at the unlocked position A, repulsive force is generated between the attachment part 51 and the first cover 30. Also, when the slide button 50 is located at the locked position B, attractive force is generated between the attachment part 51 and the first cover 30.

Figure 6A:
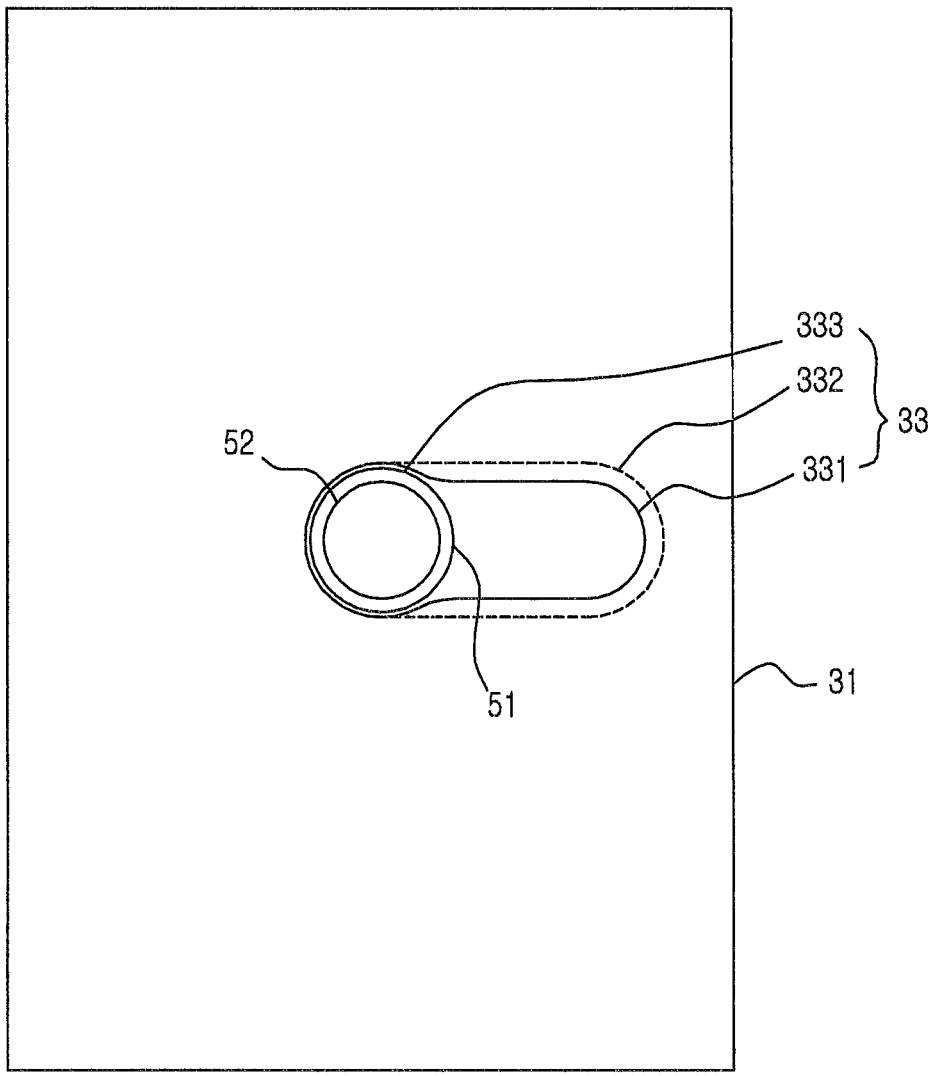
FIGS. 6A to 6C illustrate a method of operating the slide button of the packing box according to the various embodiments of the present disclosure.
Figure 6B:
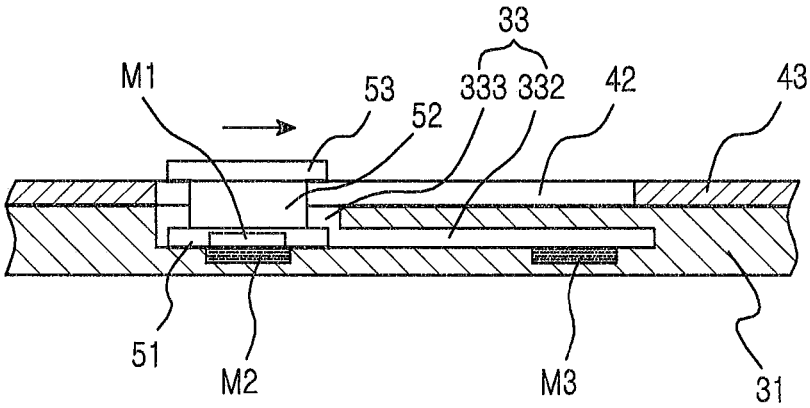
Figure 6C:
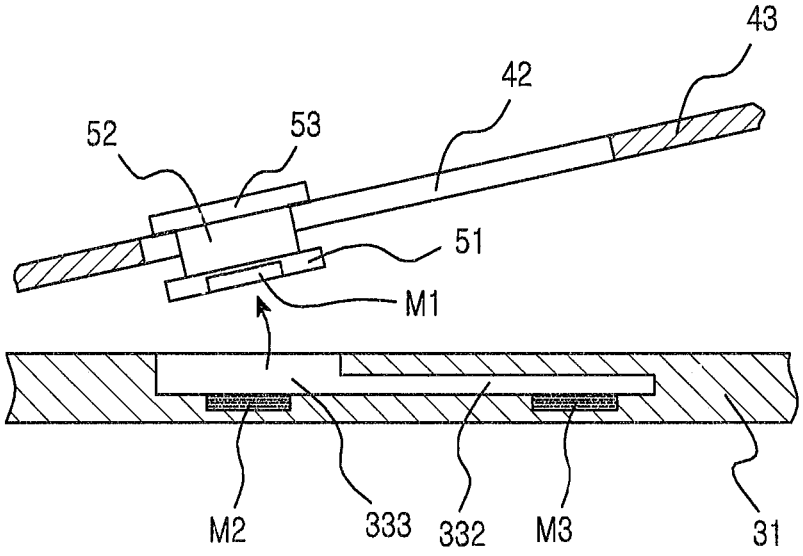

FIGS. 6A to 6C illustrate a method of operating the slide button of the packing box according to the various embodiments of the present disclosure. FIGS. 6A and 6B illustrate the state of FIG. 5. In FIG. 6A, the second cover 40 is omitted for convenience of description.

As shown in FIGS. 6A to 6C, the first cover part 31 includes the accommodation part 33 having the key shape. The accommodation part 33 includes an introduction part 333 in which the slide button 50 is introduced, a guide part 331 guiding the slide button 50, and a hook groove 332 in which the slide button 50 is fitted.

In certain embodiments of the present disclosure, the introduction part 333 is a passage through which the slide button 50 enters. The slide button 50 is accumulated in the accommodation part 33 through the introduction part 333 and moves to a right side according to guidance of the guide part 331. Here, the slide button 50 is fitted into the hook groove 332.

According to the various embodiments, when the slide button 50 is located at the introduction part 333, the repulsive force is generated by the first magnet body M1 provided in the attachment part 51 of the slide button 50 and the second magnet body M2 disposed under the introduction part 333. That is, as shown in FIG. 6C, the second magnet body M2 pushes the slide button 50 by the repulsive force to push the second cover part 43.

Figure 7A:
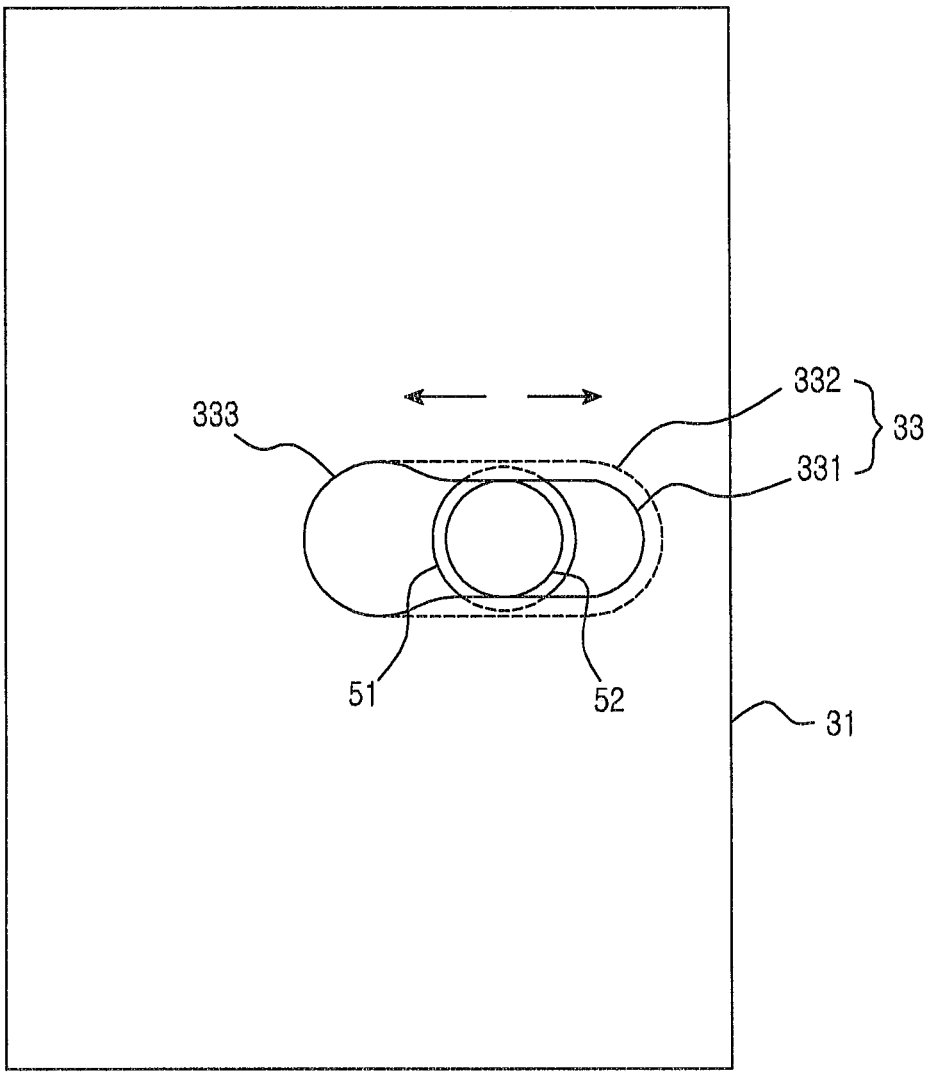
FIGS. 7A and 7B illustrate a method of operating the slide button of the packing box according to the various embodiments of the present disclosure.
Figure 7B:
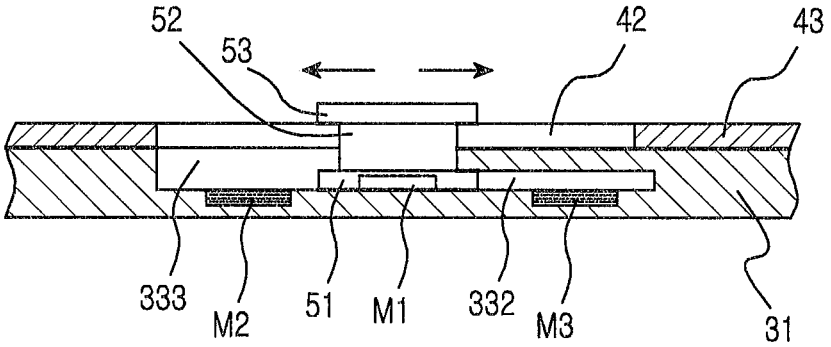

FIGS. 7A and 7B illustrate a method of operating the slide button of the packing box according to the various embodiments of the present disclosure. In FIG. 7A, the second cover 40 is omitted for convenience of description.

FIG. 7A illustrates a state in which the slide button 50 is pushed by a predetermined distance to a right side to move in a state of FIG. 6A. In this case, the slide button 50 may further move in a left or right direction along the guide part 331. For example, as described above, the slide button 50 including the first magnet body M1 can move by the second and third magnet bodies M2 and M3 that are disposed in the first cover part 31. For example, when the first magnet body M1 is close to the third magnet body M3, the slide button 50 may move in the right direction by the attractive force between the first and third magnet bodies M1 and M3. Also, when the first magnet body M1 is close to the second magnet body M2, the slide button 50 may further move in the right direction by the repulsive force between the first and second magnet bodies M1 and M2.

Figure 8A:
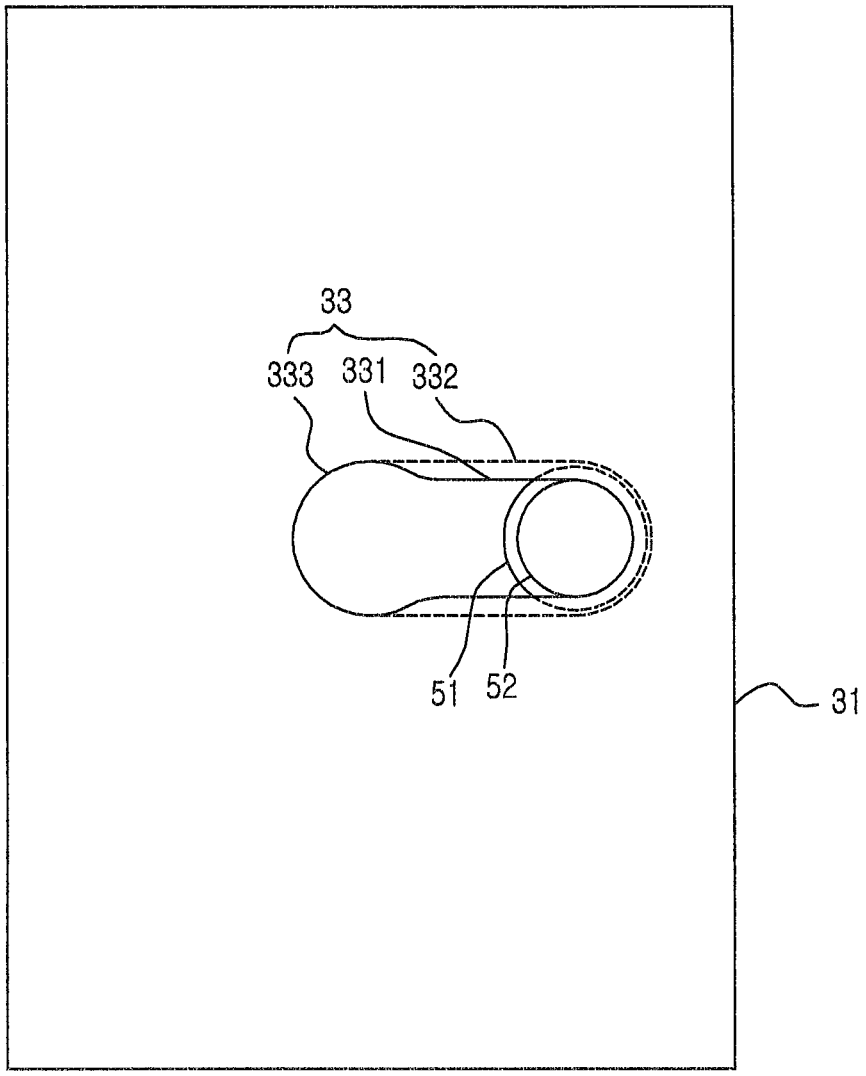
FIGS. 8A and 8B illustrate a method of operating the slide button of the packing box according to the various embodiments of the present disclosure.
Figure 8B:
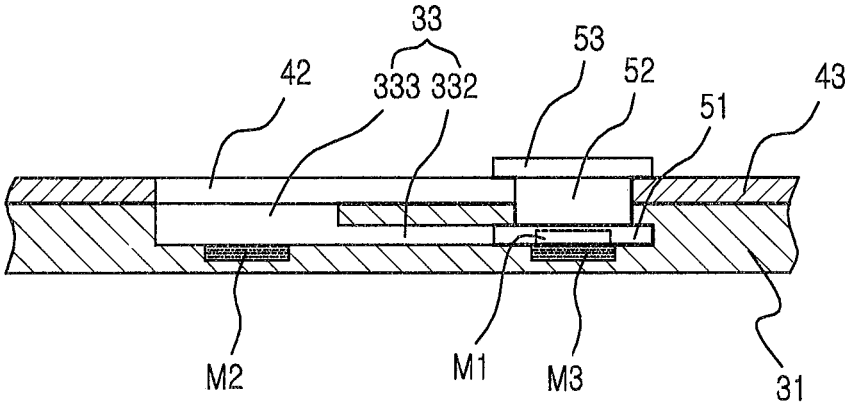

FIGS. 8A and 8B illustrate a method of operating the slide button of the packing box according to the various embodiments of the present disclosure. In FIG. 8A, the second cover 40 is omitted for convenience of description.

FIG. 8A illustrates a state in which the slide button 50 moves toward a right end in the state of FIG. 6A. In this case, the slide button 50 may be fitted into an end of the guide part 331. Also, the attachment part 51 of the slide button 50 may be fitted into an end of the hook groove 332 to fix the second cover part 43 to the first cover part 31.

According to the various embodiments, the slide button 50 and the first cover part 31 are closely attached to each other by a magnetic method. For example, the first magnet body M1 provided in the slide button 50 and the third magnet body M3 provided in the first cover part 31 can be fixed to each other by the attractive force due to the polarities differing from each other.

Figure 9:
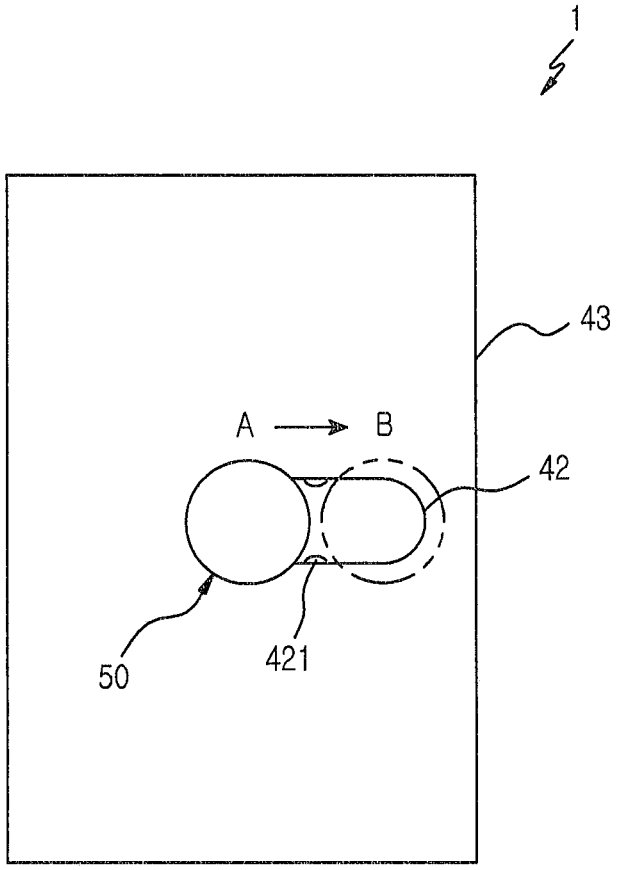
FIG. 9 illustrates a schematic view of a hook unit with respect to the slide button according to the various embodiments of the present disclosure.

FIG. 9 illustrates a hook unit with respect to the slide button according to the various embodiments of the present disclosure. FIG. 9 illustrates the state of FIG. 4.

Referring to FIG. 9, at least one hook 421 protruding from the second cover part 43 toward the hole 42 is disposed on the second cover part 43 at a predetermined distance. The hook 421 prevents the slide button 50 from easily moving from the unlocked position A to the locked position B. According to the various embodiments, the hook 421 is not to be disposed in the hole 42 of the second cover part 43 or be disposed in the accommodation part 33 of the first cover part 31.

Figure 10:
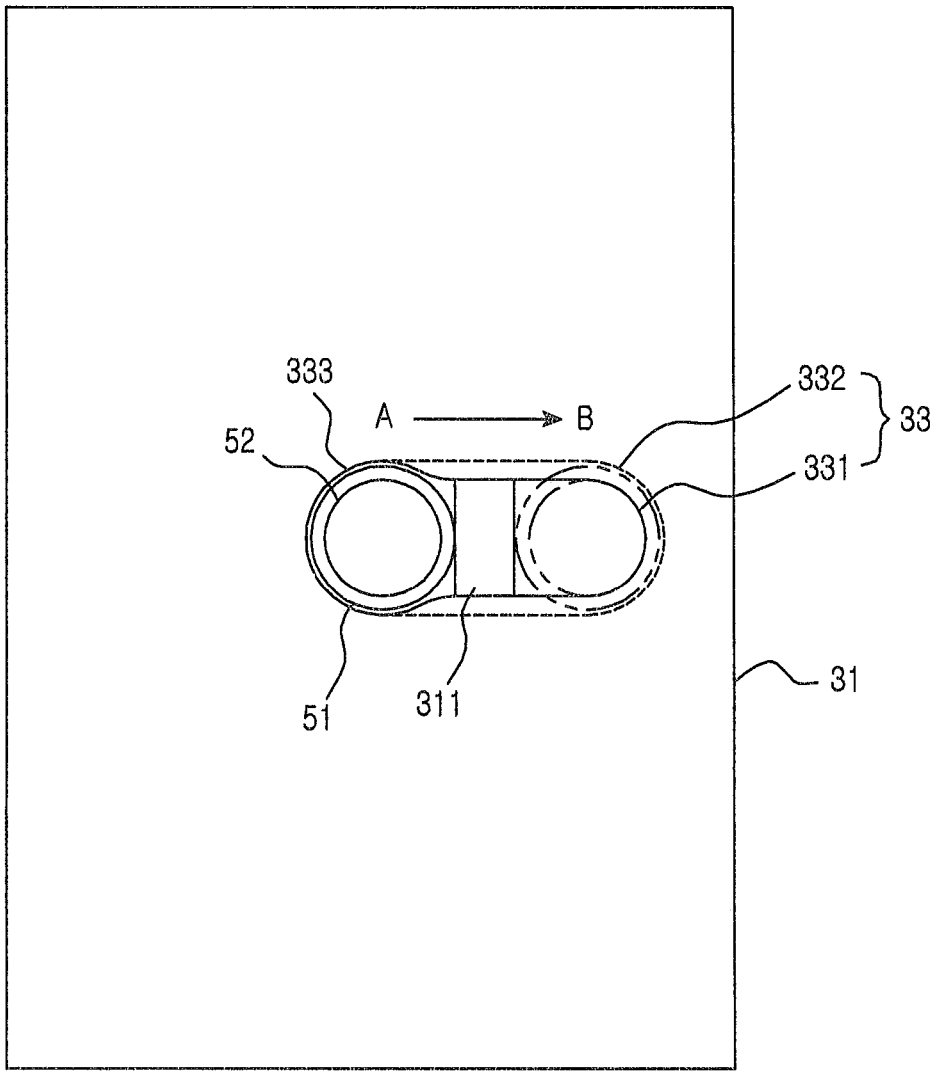
FIG. 10 illustrates a schematic view of a hook unit with respect to the slide button according to the various embodiments of the present disclosure.

FIG. 10 illustrates a hook unit with respect to the slide button according to the various embodiments of the present disclosure. FIG. 10 is a view of a state of the FIG. 4. The second cover 40 is omitted for ease of understanding.

Referring to FIG. 10, an elastic member 311 protruding upward is further disposed on the accommodation part 33 defined in the first cover part 31. The elastic member 311 prevents the slide button 50 from easily moving from the unlocked position A to the locked position B. The elastic member 311 has predetermined elastic force. When the slide button 50 presses the elastic member 311 by predetermined force, the elastic member 311 is contracted to form a space in which the slide button 50 moves. Thereafter, the elastic member 311 is expanded by restoring force thereof to block the movement of the slide button 50.

Figure 11:
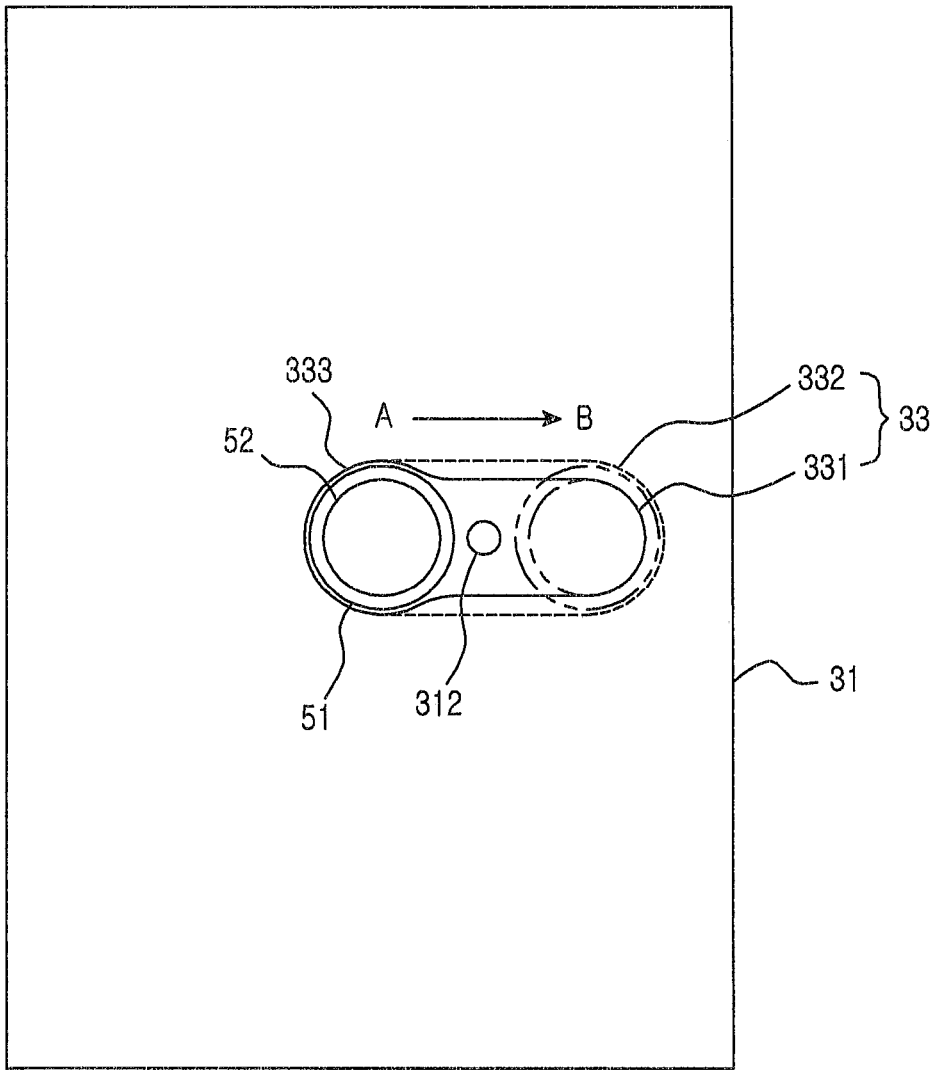
FIG. 11 illustrates a schematic view of a hook unit with respect to the slide button according to the various embodiments of the present disclosure.

FIG. 11 is schematic view illustrating a hook unit with respect to the slide button according to the various embodiments of the present disclosure. FIG. 11 illustrates the state of FIG. 4. In FIG. 11, the second cover 40 is omitted for convenience of description.

Referring to FIG. 11, a ball plunger 312 is installed at a desired position of the accommodation part 33 defined in the first cover part 31. The ball plunger 312 prevents the slide button 50 from easily moving from the unlocked position A to the locked position B. A ball protruding to the outside of the ball plunger 312 functions as a hook so that the slide button 50 does not easily operate. When the slide button 50 pushes the ball at predetermined force, the ball forms a space so that the slide button 50 is contracted by a spring of the ball plunger 312 to allow the slide button 50 to easily move. Thereafter, the ball can protrude again by restoring force of the spring of the ball plunger 312 to block the movement of the slide button 50.

According to the various embodiments of the present disclosure, a cam can be used instead of the ball plunger 312. The cam can be rotated or reciprocated by using the linear motion of the slide button 50 to block the movement of the slide button 50. The cam can include a plane cam of which an outline or groove has a plane curve and a three-dimensional cam having a spatial curve.

The packing box according to the various embodiments provides the easily storable box that is capable of being recyclable and intuitively operating to improve convenience in use.

While the disclosure has been shown and described with reference to certain embodiments, it will be understood by those skilled in the art that various changes in form and details may be made therein without departing from the spirit and scope of the disclosure as defined by the appended claims.

What is claimed is:

1. A box comprising:

a box body having an open upper portion;

a first cover openably disposed and configured to seal the open upper portion of the box body;

a second cover openably disposed and configured to overlap at least partially on the first cover; and a slide button operably disposed on the second cover and configured to fix the second cover to the first cover, wherein the first cover comprises an accommodation part in which the slide button is accommodated, and wherein the accommodation part comprises:

an introduction part configured to receive the slide button, a guide part extending from the introduction part to guide the slide button, and a hook groove configured to fit the slide button within.

2. The box of claim 1, further comprising a connection part configured to connect the first cover to the second cover.

3. The box of claim 2, wherein the first cover, the second cover, and the connection part are integrally formed with each other.

4. The box of claim 3, wherein the box body is accommodated in a top surface of the connection part, and the connection part is disposed and configured to surround the box body.

5. The box of claim 1, wherein the second cover comprises a hole having a predetermined length.

6. The box of claim 5, wherein the slide button is configured to operate in the hole.

7. The box of claim 1, wherein the accommodation part further comprises a hook unit configured to prevent the slide button from unintentionally moving in a locked or unlocked direction.

8. The box of claim 7, wherein the hook unit comprises at least one of an elastic member and a ball plunger.

9. The box of claim 1, wherein the first cover further comprises a hook protruding toward the accommodation part and configured to prevent the slide button from moving in a locked or unlocked direction.

10. The box of claim 1, wherein the box is formed of at least one of wood, a synthetic resin, and a metal.

11. The box of claim 1, wherein the slide button comprises a first magnet body having one polarity.

12. The box of claim 11, wherein the first cover comprises a second magnet body disposed so that different polarities of the first and second magnet bodies face each other, thereby fixing the second cover by using an attractive force.

13. The box of claim 12, wherein the first cover further comprises a third magnet body disposed so that a same polarity of the first and third magnet bodies face each other, thereby opening the second cover by using a repulsive force.

14. The box of claim 13, wherein the second and third magnet bodies have a same operational distance as the slide button.

15. A box comprising:

a box body having an open upper portion, the box body having side surfaces sealed by sidewalls;

a first cover rotatably fixed to one side of the box body and configured to at least partially close the open upper portion of the box body;

a second cover rotatably fixed to another side of the first cover, the second cover being disposed and configured to allow at least one portion thereof to partially overlap the first cover;

a slide button disposed with an operational distance corresponding to a predetermined length;

a first magnet body disposed on a portion at which the first magnet body faces the first cover;

an accommodation part having a length corresponding to the operational distance of at least the slide button in the first cover that the second cover overlaps;

a second magnet body disposed so that a same polarity of the first and second magnet bodies face each other to generate repulsive force at a position at which the slide button is unlocked; and a third magnet body disposed so that different polarities of the first and third magnet bodies face each other to generate attractive force at a position at which the slide button is locked, and wherein the accommodation part includes a hook groove configured to selectively hook the slide button.

16. The box of claim 15, wherein the box is formed of at least one of wood, a synthetic resin, and a metal.

17. The box of claim 15, wherein the accommodation part includes a hook unit configured to prevent the slide button from easily moving from the unlocked position to the locked position, the hook unit comprising at least one of an elastic member, and a ball plunger.

* * * * *